US008372571B2

(12) United States Patent
Yamanouchi et al.

(10) Patent No.: US 8,372,571 B2
(45) Date of Patent: Feb. 12, 2013

(54) IMAGE FORMING METHOD

(75) Inventors: Takao Yamanouchi, Kanagawa (JP); Kazue Nakamura, Tokyo (JP); Ryuichi Hiramoto, Tokyo (JP); Michiyo Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 311 days.

(21) Appl. No.: 12/886,659

(22) Filed: Sep. 21, 2010

(65) Prior Publication Data

US 2011/0076074 A1 Mar. 31, 2011

(30) Foreign Application Priority Data

Sep. 29, 2009 (JP) ..... 2009-224127

(51) Int. Cl.
*G03G 13/20* (2006.01)

(52) U.S. Cl. ..... 430/123.41; 430/123.42; 430/124.3

(58) Field of Classification Search ..... 430/123.41, 430/123.42, 124.3
See application file for complete search history.

(56) References Cited

U.S. PATENT DOCUMENTS

2007/0046963 A1* 3/2007 Nagase et al. ..... 358/1.9
2009/0034998 A1* 2/2009 Omata ..... 399/45

FOREIGN PATENT DOCUMENTS

JP 2001125411 5/2001
JP 2008116948 5/2008
JP 2009122171 6/2009

* cited by examiner

*Primary Examiner* — Hoa V Le
(74) *Attorney, Agent, or Firm* — Lucas & Mercanti, LLP

(57) ABSTRACT

Provided is a method for forming an image containing the steps of: supplying a clear toner on a surface of an image forming support; heating the supplied clear toner on the surface of the image forming support to melt; close contacting the surface of the image forming support supplied with the clear toner with a belt; and cooling the clear toner in a state of close contacting with the belt so as to form a clear toner layer on the image forming support, wherein the aforesaid clear toner contains at least a resin formed with a polymerizable monomer represented by Formula (1) and a vinyl monomer, Formula (1): $H_2{=}CR_1{-}COOR_2$, wherein $R_1$ represents a hydrogen atom or a methyl group; and $R_2$ represents a chain alkyl group having 12 to 22 carbon atoms, or a cyclic alkyl group.

7 Claims, 5 Drawing Sheets

IMAGE FORMING METHOD

CROSS-REFERENCE TO RELATED APPLICATION

This application is based on Japanese Patent Application No. 2009-224127 filed on Sep. 29, 2009 with Japan Patent Office, the entire content of which is hereby incorporated by reference.

TECHNICAL FIELD

The present invention relates to an image forming method which can produce a print provided with a matted expression on the entire surface of an image forming support using a clear toner.

BACKGROUND

There have been conventionally produced printed matters which were required relatively high image quality, such as a photographic picture or a poster, with a silver salt photography or a gravure printing method. However, it has become possible to produce such high quality images with an ink-jet printer or an electrophotographic image forming apparatus by the recent progress of digital technologies. Among digital technologies, progress of exposure technology was remarkable and it has become possible to form an exposing light having a very small dot diameter by employing a short wavelength semiconductor laser as an exposure light source by development of a blue light-emitting diode. By using various printers such as an ink-jet printer or an electrophotographic system which is provided with the aforesaid exposure device, production of a print having a high dot density of 1200 or 2400 dpi level (dpi representing a number of dots per inch (2.54 cm)) has become possible.

By the progress of the technology, there has been actively attempted recently to give high-class feeling such as texture feeling to a produced print so as to result in improving additional value to the print. For example, by adding the various processes called post processing to the produced print in the field of offset printing or screen printing, there have been produced printed maters with a high gloss finish of metallic tone or a restrained gloss finish of suede tone producing calm feeling.

Among various types of finish of prints, the needs for a matted finish or an anti-glare finish represented by the suede tone mentioned above are great. There is required a technique which can produce the matt finish print efficiently without performing the process which requires time and effort like the post-process treatment currently performed in the printing field. And it has been investigated the technique which forms the printed matter of a matted finish.

For example, in the field of electrophotography, the technique of designing a toner which is added a specific cross linkage resin or an elastomer to form an image accomplished a matted finish was examined (for example, refer to Patent documents 1 and 2). Moreover, an examination of an image forming apparatus with which an image accomplished a matted finish is acquired was also advanced by specifying the surface roughness of the side of the fixing roller which is in contact with the toner (for example, refer to Patent document 3).

Although a certain amount of matted finish effects was obtained for the print produced on an image forming support with low glossiness like a plain paper, it was found that the effects of matted finish might not no longer be acquired when image formation of a print was done on an image forming support with high glossiness like a coated printing paper. Moreover, although a matted property was exhibited in the image formation area where an ink or a toner was used to result in obtaining a certain amount of matted finish effects, the non-image formation might show the original glossiness of the image forming support, and there might produce a different finish giving a different texture feeling between the image formation area and the non-image formation area.

The inventors of the present invention tried to unify the texture feeling in the print image by performing coating the non-image formation area with colorless toner to form a toner layer in the whole image forming support in order to cancel the different texture feeling between the image formation area and the non-image formation area. Then, the inventors of the present invention prepared a clear toner containing no colorant with reference to the technique disclosed in Patent document 1 in which a toner image of a matted finish was obtained. And by applying the prepared clear toner to a non-image formation area so as to try to unify the texture feeling between the image formation area and the non-image formation area. However, it became easy to generate a gloss mottle in the non-image formation area by the effect of the wax contained in the clear toner, it was failed to unify the texture feeling between the image formation area and the non-image formation area.

Thus, in the prints produced using a image forming support with high glossiness such as a coated printing paper, it was difficult to unify the texture feeling between the image formation area formed with a toner or an ink, and the non-image formation area where a feeling of gloss of the image forming support was reflected by making the two areas to have the same level of anti-gloss finish. Therefore, when the print of an anti-gloss finish such as a suede tone is intended to produce, the post-process treatment process performed conventionally had to be performed, and it had become a problem to be solved when forming the print of an anti-gloss finish.

Patent document 1: Japanese Patent Application Publication (JP-A) No. 2008-116948

Patent document 2: JP-A No. 2009-122171

Patent document 3: JP-A No. 2001-125411

SUMMARY

An object of the present invention is to provide an image forming method which enables to unify the texture feeling between the image formation area formed with a toner or an ink, and the non-image formation area where a feeling of gloss of the image forming support may be more directly associated, when the printing is performed on an image forming support of high glossiness represented by a coated printing paper. Specifically, an object of the present invention is to provide an image forming method which enables to produce a matted finish print exhibiting the same level of texture feeling by forming a colorless toner layer on both an imaging forming area and a non-image forming area.

The inventors of the present invention found out that the above-mentioned problem was resolved by one of the embodiments having the composition described below.

1. An embodiment of the present invention is a method for forming an image comprising the steps of:

supplying a clear toner on a surface of an image forming support;

heating the supplied clear toner on the surface of the image forming support to melt;

close contacting the surface of the image forming support supplied with the clear toner with a belt; and cooling the clear toner in a state of close contacting with the belt so as to form a clear toner layer on the image forming support, wherein the aforesaid clear toner comprises at least a resin formed with a polymerizable monomer represented by Formula (1) and a vinyl monomer.

$$H_2C{=}CR_1{-}COOR_2 \qquad \text{Formula (1)}$$

wherein, $R_1$ represents a hydrogen atom or a methyl group; and $R_2$ represents a chain alkyl group having 12 to 22 carbon atoms, or a cyclic alkyl group.

2. Another embodiment of the present invention is a method for forming an image of the above-described item 1, wherein a content of the polymerizable monomer represented by Formula (1) which forms the aforesaid resin is from 0.5 to 20 weight % based on the total weight of the resin.

According to the present invention, it was possible to unify the texture feeling between the image formation area formed with a toner or an ink, and the non-image formation area where a feeling of gloss of the image forming support may be reflected, when the printing is performed on an image forming support of high glossiness represented by a coated printing paper. Namely, by using a clear toner containing a resin having the above-described composition, it was possible to produce a matted finish print exhibiting the same level of texture feeling by forming a colorless toner layer on both an imaging forming area and a non-image forming area.

Consequently, since it is possible to produce a high grade print such as a suede tone print without performing the process which requires time and effort like the post-process treatment currently performed in the printing field, it is expected that this invention contributes to expand the use of matted finish prints.

DESCRIPTION OF THE PREFERRED EMBODIMENTS

Figure 1:
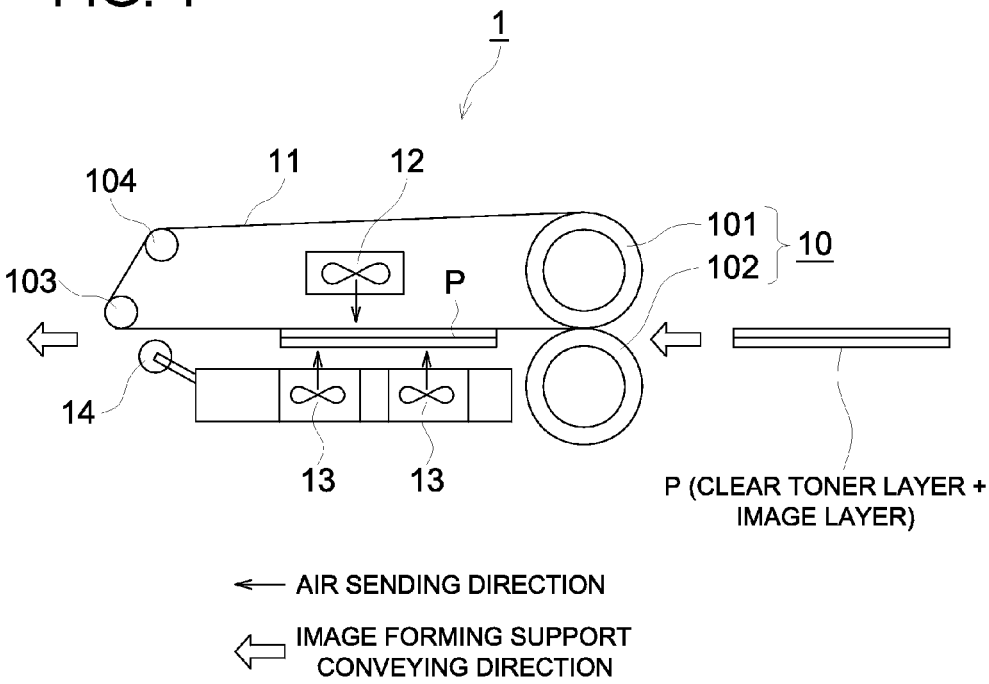
FIG. 1 is a schematic diagram of a clear toner layer forming device which can form a clear toner layer all over the image formed on an image forming support employing a clear toner.

The present invention relates to a method of forming a transparent and colorless toner layer with a toner called as a clear toner in order to give a specific matt texture to an image surface formed by well known picture formation methods, such as an electrophotographic method, an ink-jet printing method, or a process printing method.

Hereafter, the present invention will be explained in detail.

The "clear toner" as used in the present invention is a toner particle which does not contain a colorant (for example, coloration pigments, a coloration dye, black carbon particles, black magnetic particles) which exhibits coloration by absorption of light or dispersion of light. The clear toner used in the present invention is colorless and transparent. Although, in some cases, the transparency becomes slightly lower depending on the kind and the amount of added binder resin, wax or external additive, the clear toner is substantially colorless and transparent.

The "image" as used in the present invention means a medium which provides information to a user, for example, a character image or a picture image. Namely, "the image" in the present invention means not only the image forming area where a toner, or ink exists on an image forming support, but also the non-image forming area including the white background where neither toner nor ink exists, and has a form which can provide information to a user. The "image" as used in the present invention is composed of an image forming area formed by a toner or an ink, and a white background where neither toner nor ink exists. The "image" as used in the present invention includes both forms of having a clear toner layer and having no clear toner layer. Further, in the present invention, the method of forming the image before providing a clear toner layer is not specifically limited, and the target of the present invention includes images formed by the well-known image formation methods, such as an electrophotographic method, a process printing method, an ink jetprinting method, and a silver-salt photographic method.

In the present invention, it is possible to produce a print having a matted finish on the entire surface of the image forming support by providing the clear toner composed of the composition mentioned later on the image forming support on which the picture image has been formed before applying the clear toner. In the present invention, although "matted finish" or "matt texture" is used to express the finish of the produced print, these expressions mean that the produced print has a finish by which gloss was suppressed very low. As examples of an evaluation method of "matted finish", there is a quantitative evaluation method achieved by measuring the glossiness of the print as mentioned later in addition to a sensory evaluation method performed by evaluators.

The "glossiness measurement of a print" as used in the present invention is a quantitative measurement to obtain the value of reflection from the surface of the image forming support when the image forming support on which a clear toner layer is formed is irradiated with light under a prescribed condition. The glossiness can be determined, for example, according to the following procedure. Namely, covering 90% or more of the whole surface of the image forming support with a clear toner to form a clear toner layer; melting and followed by solidifying the clear toner layer by using an apparatus shown in FIG. 1, for example; then measuring the area of the clear toner layer by using a glossiness measuring device (a glossiness meter) GMX-203 (produced by MURAKAMI COLOR RESEARCH LABORATORY Co., Ltd.) with an incident angle of 75°, according to the method of "JIS/Z8741 1983 method 2" to define the calculated value as a glossiness.

Figure 5:
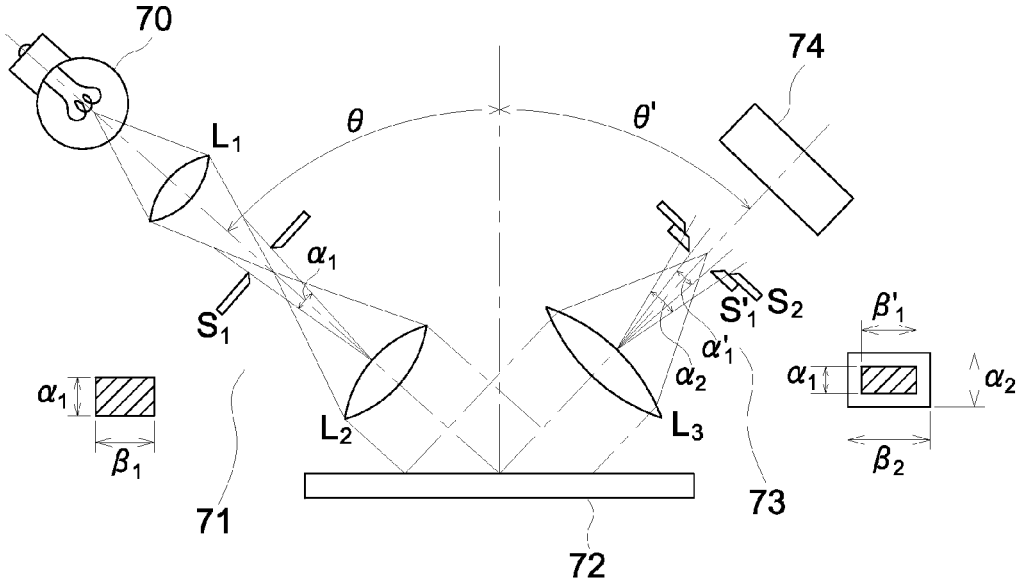
FIG. 5 is a conceptual diagram of a glossiness measuring devices (gloss meter).

A conceptual diagram of a glossiness measuring devices (gloss meter) is shown in FIG. 5. In a gloss meter, light is emitted by light source 70 and sample 72 is irradiated through optical system 71. The light reflected from the sample 72 is received by photoreceiver 74 through optical system 73. In the figure, S1 and S2 each are a slit. Further, $\alpha$1 is an opening angle of an optical image, and $\beta$1 is an opening angle in a vertical plane, $\alpha$2 is an opening angle of a photoreceiver, and $\beta$2 is an opening angle in a vertical plane. Glossiness G is represented by the following formula, provided that, when the incident angle is a prescribed angle $\theta$ as shown in the figure, the luminous flux of the specular reflection from the plane of the sample 72 is expressed as $\phi$ and the luminous flux of the reflection from a standard plane is expressed as $\phi s$.

$$G=(\phi/\phi s)\times(\text{glossiness of the used standard plane})$$

Here, the glossiness of the used standard plane is 100.0. Therefore, the glossiness is represented by a value of 100 or less. Namely, when the luminous flux of reflection increases, the glossiness G becomes closer to 100. In the present invention, when the glossiness of the print is 20 or less, it is evaluated as a print "having a matted finish or having a matt texture".

The resin which constitutes the clear toner concerning the present invention will be described.

The resin which constitutes the clear toner of the present invention contains a polymer formed with a polymerizable monomer represented by Formula (1) and a vinyl monomer. Here, the polymerizable monomer represented by Formula (1) has the following structure and it is generally called as an acrylic ester. It is a compound shown below.

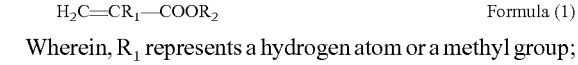

$$H_2C{=}CR_1{-}COOR_2 \qquad \text{Formula (1)}$$

Wherein, $R_1$ represents a hydrogen atom or a methyl group; and $R_2$ represents a chain alkyl group having 12 to 22 carbon atoms, or a cyclic alkyl group. In addition, the aforesaid "chain alkyl group" indicates both "a non-branched chain alkyl group" and "a branched chain alkyl group".

In the present invention, the resin is formed with an acrylic ester containing a chain alkyl group having 12 to 22 carbon atoms, or a cyclic alkyl group. It is thought that the existence of the above-mentioned alkyl group will contribute to the formation of a uniform matted finish on the image surface.

It is thought that the portion of the chain alkyl group having 12 to 22 carbon atoms, or the cyclic alkyl group will easily perform a molecular movement by the existence of the above-described molecular chain length or the cyclic structure. Therefore, there will be produced many portions which can perform a moderate molecular movement locally in a molecule order in the chain which constitutes the resin, and this movement will act so that adhesion strength may be raised in these portions. It is thought that the part which raises adhesive strength locally in a molecule order also exists in a resin of a clear toner surface.

Consequently, when a clear toner on an image forming support passes through a clear toner layer forming device, on the contact surface between the belt of the clear toner layer forming device and the clear toner, the resin will have portions exhibiting strong adhesiveness locally in a molecule order at the time of heat melting. After cooling when the image forming support is peeled off from the belt, there will be produced local portions which are not peeled off easily compared with other portion. It is thought that a uniform matted image surface can be formed by detailed irregularity being formed in a clear toner layer surface in a molecule order.

Further, in the present invention, a content of the polymerizable monomer represented by Formula (1) in the resin formed with a polymerizable monomer represented by Formula (1) and a vinyl monomer is in the range of 0.5 weight % to 20 weight % based on the total weight of the resin. By controlling the content of the acrylic ester component represented by Formula (1) in the polymer in the aforesaid range, it is thought that the areas of the high density aggregation structure will exist appropriately in the clear toner layer. Thus, by the appropriately dispersed existence of the areas having a strong adhesive force on the image forming support, it is assumed that the clear toner layer will not be peeled off from the image forming support even if a strong impact is applied to the print, and that the image of a matted finish can be stably maintained.

The aforesaid "content of the polymerizable monomer represented by Formula (1)" indicates a ratio (weight ratio) of the polymerizable monomer represented by Formula (1) based on the total weight of polymerizable monomers used for preparing the resin which constitutes the toner. It is generally called as "copolymerization ratio".

The content of the polymerizable monomer represented by Formula (1) in the resin which constitutes the clear toner of the present invention can be calculated from the used amount of the polymerizable monomers for preparing the clear toner as described later in the section of Examples. Specifically, the content of the polymerizable monomer represented by Formula (1) in the resin which constitutes the clear toner can be calculated by the following scheme.

The content of the polymerizable monomer represented by Formula (1)(weight %)=[the used amount of the polymerizable monomer represented by Formula (1)/the total used amount of the polymerizable monomers]×100

For example, when 15 weight parts of polymerizable monomer represented by Formula (1) and 85 weight parts of vinyl monomer are used to prepare a resin, the content of the polymerizable monomer represented by Formula (1) will be:

$$[15/(15+85)]\times100=15 \text{ weight \%}.$$

Moreover, it can be possible to determine quantitatively the content of the compound represented by Formula (1) from the product in the form of clear toner. For example, by using conventionally known instrumental analyses such as 13C-NMR measurement method (nuclear magnetic resonance measurement method), existence of an ester bond which is peculiar to the compound represented by Formula (1); a carbon atom number of an alkyl group located in the alcohol portion of the ester bond; and existence of a ring structure can be detected. That is, by 13C-NMR measurement method, since the peaks corresponding to the ester bond and the carbon atom number of the alkyl group of the alcoholic part which is next to the ester bond can be obtained from the spectrum acquired by measurement, the existence of these can be detectable. And the content of the polymerizable monomer represented by Formula (1) can be calculated by computing the ratio of the peak corresponding to them with respect to the total peak area.

The conditions of 13C-NMR measurement method used are as follows.

Measuring apparatus: FT NMR apparatus, Lambda 400 (JOEL Ltd.)

Measuring frequency: 100.5 MHz

Pulse condition: 4.0 μs

Data points: 32,768 points

Delay time: 1.8 sec

Frequency range: 27,100 Hz

Accumulated number: 20,000 times

Measuring temperature: 80° C.

Solvent: benzene-$d^6$/o-dichlorobenzene-$d^4$ mixture (1/4, in volume ratio)

Concentration of sample: 3 weight %

Sample tube diameter: $\phi$5 mm

Measuring mode: 1H complete decoupling

By employing the above-described conditions, it can be calculated the content of the polymerizable monomer represented by Formula (1) in the resin constituting the clear toner.

Among the compounds represented by Formula (1), examples of a compound containing a chain alkyl group having 12 to 22 carbon atoms are as follows. First, as a methacrylic compound: there are myristyl methacrylate, palmityl methacrylate, stearyl methacrylate and behenyl methacrylate. Moreover, as an acrylic compound: there are myristyl acrylate, palmityl acrylate, stearyl acrylate and behenyl acrylate. As a cyclic alkyl group for $R_2$, a 5 to 10 membered cycloalkyl group is preferable. Examples of a compound containing cyclic alkyl group for $R_2$ include: cyclohexyl methacrylate, isobornyl methacrylate, cyclohexyl acrylate, isobornyl acrylate.

Although the structures of the examples of a compound represented by Formula (1) are shown below, the compounds represented by Formula (1) which can be used in the present invention are not limited only to the examples described above and shown in the following.

TABLE 1

| Compound No. | —$R_1$ | —$R^2$ (Name of alkyl group in the alcohol portion and carbon number) |
|---|---|---|
| (1)-1 | —$CH_3$ | —$CH_2(CH_2)_{10}CH_3$(lauryl group; 12) |
| (1)-2 | —$CH_3$ | —$CH_2(CH_2)_{12}CH_3$(myristyl group; 14) |
| (1)-3 | —$CH_3$ | —$CH_2(CH_2)_{14}CH_3$(palmityl group; 16) |
| (1)-4 | —$CH_3$ | —$C_{18}H_{37}$(stearyl group; 18) |
| (1)-5 | —$CH_3$ | —$C_{18}H_{37}$(isostearyl group; 18) |
| (1)-6 | —$CH_3$ | —$CH_2(CH_2)_{20}CH_3$(behenyl group; 22) |
| (1)-7 | —$CH_3$ | —$CH_2(CH_2)_{11}CH_3$ |
| (1)-8 | —$CH_3$ | —$CH_2(CH_2)_{13}CH_3$ |
| (1)-9 | —$CH_3$ | —$CH_2(CH_2)_{15}CH_3$ |
| (1)-10 | —$CH_3$ | —$CH_2(CH_2)_{17}CH_3$ |
| (1)-11 | —$CH_3$ | —$CH_2(CH_2)_{18}CH_3$ |
| (1)-12 | —$CH_3$ | —$C_6H_{11}$(cyclohexyl group) |
| (1)-13 | —$CH_3$ | (isobomyl group) |
| (1)-14 | —H | —$CH_2(CH_2)_{10}CH_3$(lauryl group; 12) |
| (1)-15 | —H | —$CH_2(CH_2)_{12}CH_3$(myristyl group; 14) |
| (1)-16 | —H | —$CH_2(CH_2)_{14}CH_3$(palmityl group; 16) |
| (1)-17 | —H | —$C_{18}H_{37}$(stearyl group; 18) |
| (1)-18 | —H | —$C_{18}H_{37}$(isostearyl group; 18) |
| (1)-19 | —H | —$CH_2(CH_2)_{20}CH_3$(behenyl group; 22) |
| (1)-20 | —H | —$CH_2(CH_2)_{11}CH_3$ |
| (1)-21 | —H | —$CH_2(CH_2)_{13}CH_3$ |
| (1)-22 | —H | —$CH_2(CH_2)_{15}CH_3$ |
| (1)-23 | —H | —$CH_2(CH_2)_{17}CH_3$ |
| (1)-24 | —H | —$CH_2(CH_2)_{18}CH_3$ |
| (1)-25 | —H | —$C_6H_{11}$(cyclohexyl group) |
| (1)-26 | —H | (isobomyl group) |

Next, the vinyl monomer which can be used for production of the resin constituting the clear toner of the present invention is described. The vinyl monomer that can be used for production of the resin constituting the clear toner of the present invention is not specifically limited. Well-known vinyl monomers can be used for it. Among them, preferable are compounds having relatively high hydrophobicity.

Although specific examples of a vinyl monomer usable in the present invention are shown below, the vinyl monomers used in the present invention are not limited to them.

(1) Styrene or styrene derivatives:

for example, styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecyl styrene.

(2) Methacrylate derivatives:

for example, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate.

(3) Acrylate derivatives:

for example, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate.

(4) Olefins:

for example, ethylene, propylene and isobutylene.

(5) Vinyl esters:

for example, vinyl propionate, vinyl acetates and vinyl benzoate.

(6) Vinyl ethers:

for example, vinyl methyl ether and vinyl ethyl ether.

(7) Vinyl ketones:

for example, vinyl methyl ketone, vinyl ethyl ketone and vinyl hexyl ketone.

(8) N-vinyl compounds:

for example, N-vinyl carbazole, and N-vinyl indole and N-vinyl pyrrolidone.

(9) Others:

for example, vinyl compounds such as vinyl naphthalene and vinyl pyridine, acrylic acid derivatives or methacrylic acid derivatives such as acrylonitrile, methacrylonitrile and acrylamide.

In addition to the aforesaid polymerizable monomer represented by Formula (1), it can be possible to use the multifunctional vinyl monomers so as to form a resin having a cross-linking structure. Specific examples of the multifunctional vinyl compounds will be shown below.

They are, for example, divinylbenzene, ethylene glycol dimethacrylate, ethylene glycol diacrylate, diethyleneglycol dimethacrylate, diethyleneglycol diacrylate, triethylene glycol dimethacrylate, triethylene glycol diacrylate, neopentyl glycol dimethacrylate and neopentyl glycol diacrylate.

The molecular weight of the aforesaid resin is not specifically limited if it can stably exhibit the property of a clear toner. For example, it is preferable that the number average molecular weight Mn of the resin is in the range of 5,000 to 50,000. Moreover, the ratio of the weight average molecular weight Mw to the number average molecular weight Mn (Mw/Mn) is preferably from 1.0 to 1.5, for example. Since the resin melts sharply at the time of fixation when the ratio of (Mw/Mn) falls in the above-described range, it is expected that this contributes to formation of the glossy surface where image clarity is high.

The number average molecular weight Mn and the weight average molecular weight Mw of the resin which constitutes the clear toner can be calculated by the well-known molecular weight determination methods. Below, there will be described a molecular weight determination steps of a gel permeation chromatographic method (GPC) using tetrahydrofuran (THF) as a column solvent. This method is one of the representative examples of the molecular weight determination methods.

Specifically, 1 ml of THF (which has been subjected to the degasification process) is added to 1 mg of sample to be measured, and it is stirred using a magnetic stirrer under room temperature to dissolve fully. Then, after the solution is processed with a membrane filter having a pore size of 0.45 μm to 0.50 μm, it is injected in the GPC apparatus.

The measurement conditions of GPC are as follows.

The column is stabilized at 40° C., and THF is passed at a the flow rate of 1 ml/minute. About 100 μL of the sample having a concentration of 1 mg/ml is injected to perform measurement. As the column, it is preferable to use by combining a commercially available polystyrene gel column.

For example, it is preferable to combine Shodex GPC KF-801 and 802, 803, 804, 805, 806 and 807 (made by Showa Denko Co., Ltd.). It is also preferable to combine TSK gel G1000H G2000H, G3000H, G4000H, G5000H, 06000H, G7000H, and TSK guard column (made by Tosoh Co., Ltd.)

As a detector, a refractive index detector (RI detector) or a UV detector is preferably used. The molecular weight of a sample is determined by using a calibration curve which is created by using monodispersed PS standard particles to obtain the molecular weight distribution of the sample. It is preferable to use about ten points of polystyrene particles for making a calibration curve.

The determination of molecular weight can be performed under the following measurement conditions, for example.

(Measurement Conditions)

Apparatus: HLC-8220 (manufactured by Tosoh Co., Ltd.)

Column: GMHXL×2, G2000HXL×1

Detector: RI detector or UV detector

Flow speed of eluent: 1.0 ml/min.

Concentration of sample: 0.01 g/20 ml

Injection amount: 100 μL

Calibration curve: made by using standard polystyrene particles.

Next, the production method of the clear toner concerning the present invention will be described.

The clear toner concerning the present invention contains at least a resin which is formed by a polymerizable monomer represented by the aforesaid Formula (1) and a vinyl monomer. The production methods of the particles which constitute the clear toner of the present invention are not specifically limited, and well-known production methods for preparing toners used for the image formation of an electro photography can be applied. That is, a toner production method of so called a pulverization method which produces toner through kneading, powdering and classification manufacturing process, or a toner production method of so called a polymerization method in which a polymerizable monomer is polymerized, and at the same time, particle formation is performed by controlling the form and the size of the particles can be applicable.

Among them, the clear toner produced by the polymerization method is considered to exhibit the characteristics such as uniform particle size distribution, uniform shape distribution, and sharp charging distribution. The toner production method by the polymerization method contains the manufacturing step of forming resin particles by polymerization reaction, such as suspension polymerization or emulsion polymerization, for example. Especially, the particles produced through coagulation/fusion step of resin particles which are initially produced in the polymerization reaction are preferable.

There will be described a preparation method of the clear toner according to the present invention by a process of emulsion association, as an example of preparation method of the clear toner according to the present invention. Preparation of a clear toner by a process of emulsion association is conducted, for example, through the following steps.

(1) Preparation step of resin particle dispersion (2) Coagulation/fusion step of resin particles (3) Ripening step (4) Cooling step (5) Washing step (6) Drying step (7) External additive treatment step Hereafter, each process will be explained.

(1) Preparation Step of Resin Particle Dispersion

This step is to form a resin which constitutes the clear toner. Specifically, a polymerizable monomer represented by the aforesaid Formula (1) and a vinyl monomer are fed into an aqueous medium and dispersed. Then the dispersion is allowed to polymerize to form resin particles having a size of approximately 100 nm.

In this step, after adding the polymerizable monomer represented by the aforesaid Formula (1) and a vinyl monomer into the aqueous medium, for example, oil droplets of the monomers are formed by performing dispersion processing. And resin particles are formed by performing a radical polymerization reaction in the oil droplets dispersed in the aqueous medium.

A radical polymerization reaction enables to form a resin through a polymerization reaction as follows. By incorporating a polymerization initiator in the above-described oil droplets to generate a radical in the oil droplets, the polymerization reaction of the polymerizable monomer represented by Formula (1) and the vinyl monomer will begin in the oil droplets to form a resin. Or radical polymerization can also be started by providing the radical generated from the polymerization initiator added in the aqueous medium into the oil droplets.

Although the temperature to perform radical polymerization varies depending on the type of polymerizable monomer represented by Formula (1) and vinyl monomer and the type of polymerization initiator which generates a radical, usually it is preferable to be from 50 to 100° C., and it is more preferable to be from 55 to 90° C. Moreover, although polymerization reaction time varies depending on the type of polymerizable monomer represented by Formula (1) and vinyl monomer, and a reaction rate of a radical, it is preferable to be from 2 to 12 hours.

In this step, after adding the polymerizable monomer represented by the aforesaid Formula (1) and a vinyl monomer into the aqueous medium, the oil droplets of the monomers are formed by performing dispersion processing with the effect of mechanical energy produced by a well-known method. A dispersing apparatus which performs dispersion of oil droplets with mechanical energy is not limited in particular. A commercially available stirring apparatus provided with a high speed rotating rotor, for example, CLEAMIX (made by M Technique Co., Ltd.) is cited as a representative apparatus for this purpose. Other than the aforesaid stirring apparatus, there can be used apparatuses such as ultrasonic dispersion apparatus, mechanical homogenizer, Manton-Gaulin homogenizer or pressure homogenizer. By using these apparatuses, it is possible to form resin particles having a size of approximately 100 nm in the aqueous medium.

Moreover, the "aqueous medium" as used in the present invention is a liquid which consists of water and an organic solvent which can be dissolved in water. The liquid contains water in an amount of 50 weight % or more. Examples of an organic solvent which can be dissolved in water to form an aqueous medium include: methanol, ethanol, isopropanol, butanol, acetone, methyl ethyl ketone and tetrahydrofuran. Among them, alcoholic organic solvents such as methanol, ethanol, isopropanol and butanol are preferable, since they will not dissolve the resin.

(2) Coagulation/Fusion Step of Resin Particles

In this step, the resin particles prepared in the foregoing step are allowed to coagulate in an aqueous medium and to fuse the coagulated particles by heating to prepare particles of a clear toner. These particles are called as "parent resin particles" and an external additive are not yet added to them. That is, this is a step to coagulate and to fuse the particles formed by polymerizing a polymerizable monomer represented by Formula (1) and a vinyl monomer to obtain particles of a predetermined increased size.

In this step, a coagulant of an alkali metal salt or an alkaline earth metal salt such as magnesium chloride is added to an aqueous medium containing resin particles to coagulate these particles. Subsequently, the aqueous medium is heated at a temperature higher than the glass transition temperature of the resin particles to allow coagulation to proceed and to allow coagulated resin particles to fuse. And when coagulation is advanced to an extent that the size of particles reaches the targeted particle size, a salt such as sodium chloride is added to stop coagulation.

(3) Ripening Step

Subsequent to the foregoing coagulation/fusion step, the reaction system is subjected to a heat treatment to ripen the particles to reach the targeted average circularity. This ripening step is also called as the shape controlling step.

(4) Cooling Step

In this step, a dispersion of the aforesaid particles is subjected to a cooling treatment (rapid cooling treatment). A cooling treatment is conducted at a cooling rate of 1 to 20° C./min. A cooling treatment is not specifically limited and examples thereof include a method in which a cooling medium is introduced from the outside of a reactor and a method in which cold water is fed directly to the reaction system.

(5) Washing Step

This step contains a solid/liquid separation step of separating particles from the particle dispersion which was cooled to a prescribed temperature in the foregoing step and a subsequent washing step to remove any attached surfactant, coagulant or the like from the particles which has become a cakey aggregate called as a wet toner cake by the solid/liquid separation.

Washing is conducted with water until the electric conductivity of the filtrate reaches a level of 10μS/cm. Examples of methods for a solid/liquid separation include a centrifugal separation method, a reduced-pressure filtration method using a Nutsche funnel and a filtration method using a filter press. However, the present invention is not limited thereto.

(6) Drying Step

In this step, the aforesaid washed particles are dried. Examples of a dryer usable in this step include a spray dryer, a vacuum freeze-dryer and a reduced-pressure dryer. However, it is preferred to use a standing plate dryer, a mobile plate dryer, a fluidized-bed dryer, a rotary dryer or a stirring dryer.

The moisture content of dried particles is preferably not more than 5 weight %, and more preferably it is not more than 2 weight %. In cases when the dried particles are aggregated by a weak attractive force between particles to form an aggregate, such aggregate may be subjected to a disintegration treatment. There are usable mechanical disintegrators such as a jet mill, a HENSCHEL MIXER, a coffee mill or a food processor.

(7) External Additive Treatment Step

In this step, an external additive or a lubricant is added to dried particles. The particles which have been subjected to the drying step may be used as clear toner particles, but addition of an external additive can enhance the electrostatic-charging property, fluidity and cleaning property. External additives usable in the present invention include, for example, organic or inorganic particles and aliphatic metal salts. An external additive is added preferably in an amount of 0.1 to 10.0 weight %, and more preferably 0.5 to 4.0 weight %. A variety of additives may be combined. Examples of a mixing device, used to add external additives include a turbuler mixer, a HENSCHEL MIXER, a Nautor Mixer, a V-type mixer and a coffee mill.

As inorganic particles, conventionally known compounds may be used. Preferable examples of inorganic particles employed are fine particles of silica, titania, alumina and strontium titanate. These inorganic particles after subjected to hydrophobic treatment can also be used if required.

Specific examples of silica fine particles include commercially available products of: R-805 R-976, R-974, R-972, R-812 and R-809 (made by Nippon Aerosil Co., Ltd.); HVK-2150 and H-200 (made by Hoechst Corporation); and TS-720 TS-530, TS-610, H-5, MS-5 (made by Cabot Corporation.)

Examples of titania particles include commercially available products of T-805 and T-604 (made by Nippon Aerosil Co., Ltd.); MT-600S, MT-100B, MT-500BS, MT-600, MT-600SS and JA-1 (made by Teika Corporation); TA-300SI, TA-500, TAF-130, TAF-510 and TAF-510T (made by Fuji Titanium Industry Co. Ltd.).

Examples of alumina particles include commercially available products of RFY-C and C-604 (made by Nippon Aerosil Co., Ltd.); and TTO-55 made by (Ishihara Sangyo Co. Ltd.).

Organic particles having a number average primary particle of 10 to 2,000 nm can be used as an external additive. Examples of the organic fine particles are: homopolymer or copolymer of a styrene resin, and a methyl methacrylate resin.

The external additives are preferably contained in an amount of 0.1 to 10.0 weight % based on the total weight of the toner.

According to the foregoing steps, the clear toner according to the present invention can be produced via an emulsion association method.

Next, there will be described a polymerization initiator, a dispersion stabilizer and a surfactant usable in the emulsion association method to prepare the clear toner of the present invention.

The binder resin constituting the clear toner of the present invention is formed by a polymerizable monomer represented by Formula (1) and a vinyl monomer. It can be used a well-known oil soluble or water soluble polymerization initiator. Specific examples of an oil soluble polymerization initiator include: an azo or diazo polymerization initiator and a peroxide polymerization initiator as listed below.

(1) Azo based or diazo based polymerization initiators:

2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

(2) Peroxide based polymerization initiators:

Benzoyl peroxide, methyl ethyl ketone peroxide, diisopropylperoxycarbonate, cumenehydroperoxide, t-butylhydroperoxide, di-t-butyl peroxide, dicumyl peroxide, 2,4-dichlorobenzoyl peroxide, lauroyl peroxide, 2,2-bis-(4,4-t-butylperoxycyclohexyl)propane and tris-(t-butylperoxy) triazine.

Moreover, a water soluble radical polymerization initiator can be used when resin particles are formed via an emulsion polymerization method. Examples of a water soluble radical polymerization initiator include: a persulfuric salt such as potassium persulfate or ammonium persulfate, azobisaminodipropane acetate, azobiscyanovaleric acid and salt thereof, and hydrogen peroxide.

In this polymerization step, conventionally used chain transfer agents can be employed in order to regulate the molecular weight of the resin for forming the resin particles. Examples of a chain transfer agent include: n-octylmercaptan, n-decylmercaptan, tert-dodecylmercaptan, n-octyl-3-mercaptopropionic acid ester; terpinolene and α-methylstyrene dimer.

In the present invention, a clear toner is produced by the following steps: dispersing a compound represented by the aforesaid Formula (1) and a vinyl monomer in an aqueous medium; polymerizing the monomers under the dispersion state to form resin particles; dispersing in an aqueous medium the resin particles obtained by polymerization; and coagulating and fusing the resin particles to result in preparing the target clear toner. It is preferable that a dispersion stabilizer is used to stably disperse the toner forming material in the aqueous medium. Examples of a usable dispersion stabilizer include: tricalcium phosphate, magnesium phosphate, zinc phosphate, aluminium phosphate, calcium carbonate, magnesium carbonate, calcium hydroxide, magnesium hydroxide, aluminium hydroxide, calcium metasilicate, calcium sulfate, barium sulfate, bentonite, silica and alumina. Further, there can be used compounds generally known as surfactants such as polyvinyl alcohol, gelatin, methyl cellulose, sodium dodecylbenzenesulfonate, ethylene oxide adduct and sodium higher alcohol sulfonate.

When polymerization is carried out in an aqueous medium using polymerizable monomers, it is required to disperse uniformly the oil droplets of the aforesaid polymerizable monomers in the aqueous medium by employing a surfactant. Although surfactants that can be used are not limited in particular at this time, an ionic surfactant listed below can be uses as a preferable compound. There are a sulfonic acid salt, a sulfuric acid ester salt and a fatty acid salt in an ionic surfactant. Examples of a sulfonic acid salt include: sodium dodecylbenzenesulfonate, sodium aryl alkyl polyether sulfonate, sodium 3,3-disulfonediphenylurea-4,4-diazo-bis-amino-8-naphthol-6-sulfonate, ortho-carboxybenzene-azo-dimethylaniline, sodium 2,2,5,5-tetramethyl-triphenylmethane-4,4-diazo-bis-β-naphthol-6-sulfonate.

Examples of a sulfuric acid ester salt include: sodium dodecyl sulfate, sodium tetradecyl sulfate, sodium pentadecyl sulfate and sodium octyl sulfate. Examples of a fatty acid salt include: sodium oleate, sodium laurate, sodium caprate, sodium caprylate, sodium caproate, potassium stearate and calcium oleate.

Further, it is also possible to employ a nonionic surfactant. Examples thereof include: polyethylene oxide, polypropylene oxide, combination of polypropylene oxide and polyethylene oxide, ester of polyethylene glycol with higher fatty acid, alkylphenol polyethylene oxide, ester of higher fatty acid and polyethylene glycol, ester of higher fatty acid and polypropylene oxide and sorbitan ester.

Next, a clear toner layer forming device will be explained, in which, the clear toner according to the present invention is provided on the entire surface of the image forming support on which an image has been formed beforehand, and the clear toner is heated and then cooled while the clear toner is in contact with a belt member to form a matted clear toner layer on the entire surface of the image forming support. FIG. 1 is a schematic diagram showing a typical example of a clear toner layer forming device which forms a clear toner layer on the entire surface of the image forming support employing the clear toner according to the present invention.

Clear toner layer forming device 1 shown in FIG. 1 has at least the following constitutions.

(1) Heating/pressurizing member 10 which heats image forming support P on which the clear toner has been provided on the entire surface of the image while pressing;

(2) Belt member 11 which contacts the clear toner layer which is melted by heating/pressurizing member 10 to form a contact surface between the clear toner surface, and conveys image forming support P;

(3) Cooling fans 12 and 13 which supply cooling air to image forming support P which is being conveyed while being in contact with belt member 11;

(4) Conveyance roll 14 which conveys image forming support P on which the clear toner layer is fixed by cooling with the air supplied from cooling fans 12 and 13;

Hereafter, each constitution will be specifically explained.

Heating/pressurizing member 10 will be explained, first. In heating/pressurizing member 10 shown in FIG. 1, image forming support P on which a clear toner layer is provided is inserted between a pair of rolls 101 and 102 driven at a constant speed to be carried and image forming support P is heated and pressed. Namely, the clear toner supplied on the entire surface of image forming support P is melted by the heat supplied from heating/pressurizing member 10 and the melted clear toner can form a clear toner layer having a uniform thickness by being pressed. Here, by providing a heat source in the center of one of the pair of rolls 101 and 102, or both, the heat source can heat so that the clear toner supplied on the entire surface of the image forming support is melted. The pair of rolls 101 and 102 preferably has a structure in which the two rolls are pushed each other so as to surely press the melted clear toner between the rolls.

Clear toner layer forming device 1 shown in FIG. 1 may have a structure in which roll 101 works as a heating roll and roll 102 works as a pressurizing roll, from the viewpoint of the electrical consumption and working efficiency, by which sufficient heating and pressurizing are possible. On the surface of one of or both of roll 101 and roll 102 constituting heating/pressurizing member 10, a silicone rubber or a fluorine containing rubber may be provided, and the width of the nip region where heating and pressurizing are conducted is preferably 1 mm to 8 mm.

Heating roll 101 has a structure in which an elastic layer containing, for example, a silicone rubber is coated on a surface of a metallic core made of, for example, aluminum to have a predetermined outer diameter. In the inside of heating roll 101, for example, a halogen lamp of 300 to 350 W is installed as a heat source to heat heating roll 101 from inside so that the surface temperature reaches the predetermined temperature.

Pressurizing roll 102 has a structure in which an elastic layer containing, for example, a silicone rubber is coated and covered by, for example, a tube of PFA (tetrafluoroethylene/perfluoroalkyl vinyl ether copolymer) as a separator layer, on a surface of a metallic core made of, for example, aluminum to have a predetermined outer diameter. Also in the inside of pressurizing roll 102, for example, a halogen lamp of 300 to 500 W may be installed as a heat source to heat pressurizing roll 102 from inside so that the surface temperature reaches the predetermined temperature.

In heating/pressurizing member 10, image forming support P on which the clear toner is provided all over the image forming surface is introduced in a press contact portion between the rolls which are pushed with each other (called as "a nip portion") so that the surface provided with the clear toner is on the heating roll 101 side, and while it passes through the portion where rolls 101 and 102 are pushed with each other, the clear toner is melted by the heat and simultaneously fused onto the image to form a clear toner layer of the predetermined thickness.

Next, belt member 11 will be explained. As shown in FIG. 1, belt member 11 has an endless belt structure which is supported by heating roll 101 and other plural belts including heating belt 101, namely, rolls 101, 103 and 104, so as to be rotatable. As mentioned above, belt member 11 is set up by plural rolls including heating roll 101, release roll 103, and driven roll 104, and belt member 11 is driven to rotate at a predetermined speed by heating roll 101 which is rotated by a drive source which is not illustrated. Thus, belt member 11 is driven to rotate at a predetermined process speed without wrinkle by the drive forth due to heating roll 101 and a tension provided by release roll 103 and driven roll 104.

Since belt member 11 forms a contact surface with the melted clear toner surface and transfer material P is conveyed through the melted clear toner surface, it can be produced with a known material which possesses a certain extent of heat resistance and mechanical strength. Specifically, for example, heat-resistant film resins such as polyimide, polyether polyimide, PES (polyethersulfone) and PFA (tetrafluoro ethylene—perfluoroalkyl vinyl ether copolymer) are cited. It is preferable that, a release layer containing a fluorine containing resin such as PTFE (polytetrafluoroethylene) or PFA, or a silicone rubber is formed at least on a surface where the clear toner layer contacts of the above-mentioned heat-resistant film resin.

The thickness of belt member 11 is not specifically limited if image forming support P can be conveyed through a contact surface with the melted clear toner surface, and a belt member with a well known thickness is usable. Specifically, the thickness of a heat-resistant film resin is preferably 20 μm to 80 μm, the thickness of a release layer is preferably 10 μm to 30 μm, and the total thickness is preferably 20 μm to 110 μm. A specific example is a belt composed of an endless polyimide film having a thickness of 80 μm on which is covered a silicone layer having a thickness of 30 μm.

The surface roughness (Ra) of the belt member 11 is preferably from 0.2 μm to 1.0 μm. Here, the surface roughness (Ra) can be measured by taking a picture of a surface condition of the belt member with a commercially available laser microscope "VK-9500 (made by Keyence Corporation). Specifically the measurement was done by the following procedures. At first, a picture of the surface condition of the belt member was taken with "VK-viewer" attached to the aforesaid laser microscope VK-9500. The obtained image of the belt surface was subjected to the measurement using "VK-Analyzer" attached to the laser microscope VK-9500 using the mode of "line roughness (based on JIS B0601 1994)" with a cut-off value of 0.08 mm to obtain an average arithmetic roughness Ra. The width for measuring surface roughness was taken at the center section of the image to obtain a full width of the image and the measurement was carried out.

The surface temperature of the belt member 11 is preferably from 120° C. to 155° C. Here, the surface temperature of the belt member 11 was measured at the center portion of the surface of the belt member 11 near the inlet of the press contact portion (nip portion) of the heating/pressurizing member 10 with taking a distance of 50 cm from the nip portion using a radiation thermometer TA-0510F (made by the Konica Minolta Sensing, Inc.).

The surface pressure at the press contact portion (nip portion) of the heating/pressurizing member 10 is preferably from 100 kPa to 300 kPa when measured with an apparatus PINCH (made by Kamata Inductry Co., Ltd.) for measuring a pressure distribution between rollers through the belt member 11. Specifically the measurement was done by the following procedures. A surface pressure sensor (A3 size, 437 mm, made by Nitta Co., Ltd.) was connected to the pressure distribution measurement apparatus PINCH (made by Kamata Inductry Co., Ltd.) through the belt member 11 at the press contact portion (nip portion) which was stopped driving. The pressure P(x) (unit: kPa) between the nip was measured in the paper transportation direction (x axis) at the moment of 30 seconds standing still while pressing.

Next, cooling fans 12 and 13 will be explained. Clear toner layer forming device 1 shown in FIG. 1 has cooling fan 12 between heating roll 101 and release roll 103 in the inside of the foregoing belt member 11, and has cooling fan 13 between pressurizing roll 102 on the outside of belt member 11 and conveyance assist roll 14. Here, the outer surface of belt member 11 is a surface which conducts support and conveyance of image forming support P while it is adhered with image forming support P through the melted clear toner surface to form a contact surface.

In clear toner layer forming device 1 of FIG. 1, the clear toner layer is melted by the aforesaid heating/pressurizing member 10 and pressed to attain a predetermined thickness. Image forming support P is conveyed while the clear toner layer is adhered on the outer surface of belt member 11, and simultaneously, the clear toner layer is cooled to solidify. Cooling fans 12 and 13 compulsorily cool image forming support P having the clear toner layer while being conveyed. Clear toner layer forming device 1 may be equipped with a heat sink or a heat pipe for cooling in connection with cooling fans 12 and 13. By means of such a heat sink or heat pipe for cooling, the cooling of the melted clear toner layer can be promoted.

The solidification of the clear toner layer of image forming support P under conveyance by belt member 11 is promoted by forced cooling by the above-mentioned cooling fans 12 and 13, and the clear toner layer is fully cooled and solidified when the clear toner layer is conveyed near the end where conveyance assist roll 14 and release rolls 103 are provided. Then, image forming support P is exfoliated from belt member 11, according to the following procedures.

Image forming support P conveyed near the end is conveyed while supported by belt member 11 through the clear toner layer. In this condition, conveyance assist roll 14 becomes in touch with the back surface of image forming support P to assist the conveyance. When image forming support P is conveyed to release roll 103 while supported by conveyance assist roll 14 from backside, belt member 11 changes the conveyance direction toward driven roll 104 (upward in the figure). At this moment, image forming support P exfoliates from transfer material 11 according to the stiffness of transfer material 11 itself and it is discharged from clear toner layer forming device 1 by the assistance of conveyance assist roll 14.

According to the above-mentioned procedures, clear toner layer forming device 1 provides the clear toner all over the surface of the image forming support where an image has been formed, then by giving heat and pressure to the provided clear toner, it can be formed a melted clear toner layer having a predetermined thickness. And by cooling and solidifying the clear toner layer while conveying image forming support P on which melted clear toner layer is formed by the belt member, image forming support P is exfoliated from belt member 11 after the clear toner layer solidifies, and image forming support P is discharged from the device.

In clear toner layer forming device 1, exfoliation of image forming support P from belt member 11 is conducted with the aide of conveyance assist roll 14 and release roll 103. It is also possible to use an exfoliation claw placed between belt member 11 and image forming support P, instead of release roll 103.

As mentioned above, in the present invention, a method for preparing an image (i.e., a area where a toner or an ink exists) is not specifically limited. For example, it can be used an image formed by a known image forming method such as an electrophotographic method, an inkjet method or a silver-salt photographic method. By providing a clear toner on the surface of the image formed by a known image forming method, namely on the entire image surface, it can be formed a clear toner layer exhibiting a matted effect.

Figure 2:
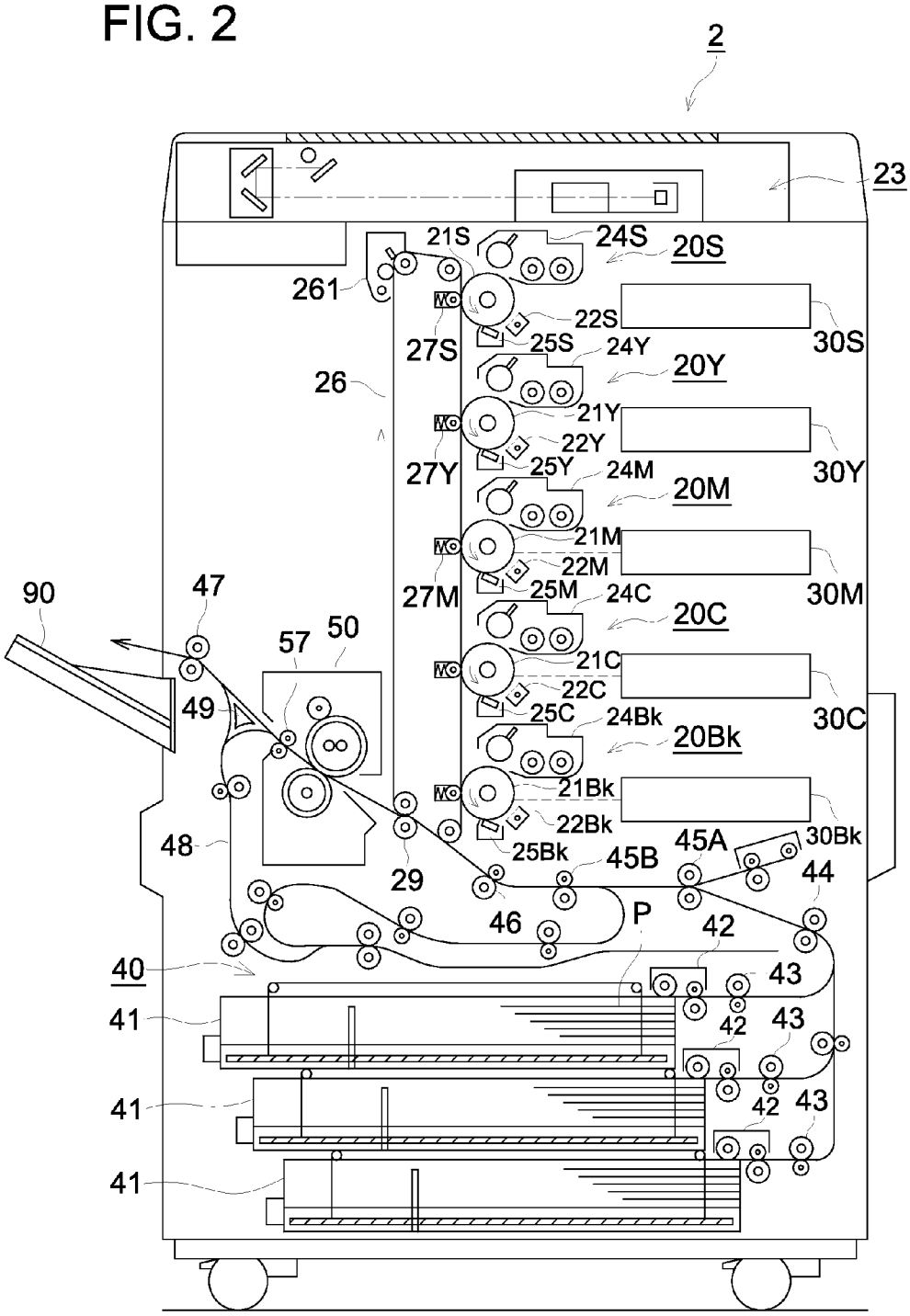
PRIOR ART FIG. 2
FIG. 2 is a cross-sectional configuration diagram of an image forming device which forms a full color toner image and also a clear toner layer all over the full color toner image on an image fanning support.

FIG. 2 is a cross-sectional configuration diagram of an image forming device which enables to form a full color toner image with an electrophotography and also to form a clear toner layer all over the formed full color toner image. A clear toner layer forming device installed in the image forming device shown in FIG. 2 has a different configuration from clear toner layer forming device 1 in FIG. 1, however, it is composed of clear toner layer forming unit 20S which supplies the clear toner and fixing device 50 which heats and pressurizes the clear toner to form a clear toner layer.

Figure 3:
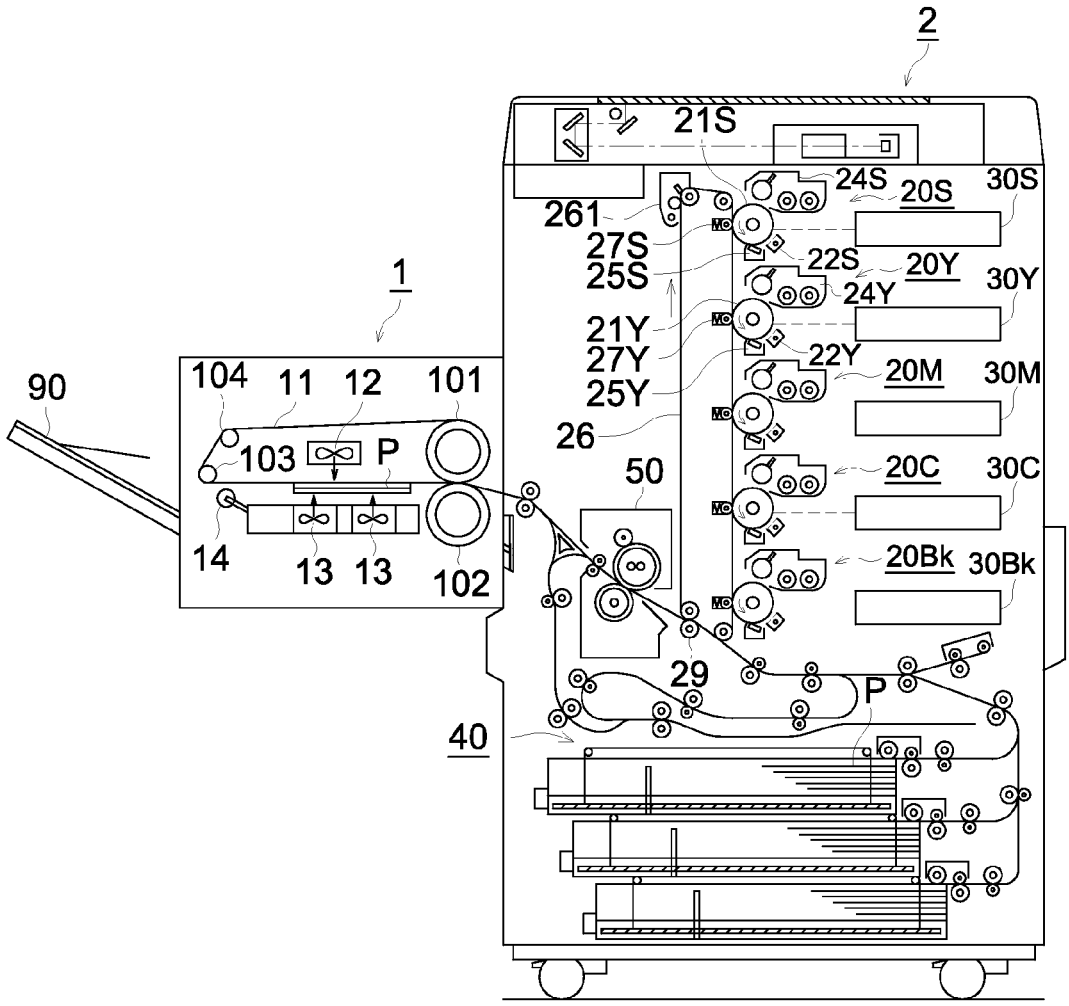
FIG. 3 is a schematic diagram showing an example of a device in which a clear toner layer forming device is installed in the image forming device of FIG. 2.

When a full color image having a clear toner layer is formed with the image forming device shown in FIG. 2, it is preferable that clear toner layer forming device 1 of FIG. 1 is arranged in the configuration to be in the vicinity of paper discharge member 90 of image forming device 2 as is shown in FIG. 3. By making such configuration, the print subjected to fixing treatment with fixing device 50 built in the image formation apparatus of FIG. 2 is treated again with clear toner layer forming device 1. As a result, the strength of the clear toner layer formed all over the surface of the image forming support is raised further. At the same time, uniform matt texture can be given on the image. Moreover, since the fixing strength of a toner image is also increased, it is especially desirable for producing a poster used for an outdoor notice. In addition, an example of a configuration of clear toner layer forming device 1 to image forming device 2 shown in FIG. 2 will be mentioned later using FIG. 3.

Image forming device 2 shown in FIG. 2 is commonly called as a tandem type color image forming device and contains clear toner layer forming unit 20S, a plurality of toner image forming units 20Y, 20M, 20C and 20Bk, intermediate transfer belt 26, sheet feeder 40 and fixing device 50.

Image reading device 23 is placed on the upper part of image forming device 2. A manuscript placed on a manuscript holder is image-scanning-exposed to light emitted by an optical system of a manuscript image-scanning exposure device in image reading device 23 to read the image in a line image sensor. The analog signals photoelectrically converted by the line image sensor are input to light exposure devices 30S, 30Y, 30M, 30C and 30Bk, after conducting analog processing, A/D conversion, a shading correction and image compression processing in a control section.

In the present invention, in naming a component generically, the reference numerals in which alphabet subscript is omitted are used, and in pointing out discrete components, the reference numerals which is attached with the subscript of S (clear toner), Y (yellow), M (magenta), C (cyan), and Bk (black) are used.

In image forming device 2 shown in FIG. 2, there are provided with clear toner layer forming unit 20S which supplies a clear toner all over the image forming support employing the clear toner according to the present invention, yellow image forming unit 20Y which performs yellow toner image formation, magenta image forming unit 20M which performs magenta toner image formation, cyan image forming unit 20C which performs cyan toner image formation, and black image forming unit 20Bk which performs black toner image formation. Each toner image forming unit 20 (20S, 20Y, 20M, 20C and 22Bk) contains a charging electrode 22 (22S, 22Y, 22M, 22C and 22Bk), an exposing member 30 (30S, 30Y, 30M, 30C, 30Bk), a developing member 24 (24S, 23Y, 24M, 24C, 24Bk) and a cleaning member 25 (25S, 25Y, 25M, 25C, 25Bk) each located around a drum shaped photoreceptor 21 (21S, 21Y, 21M, 21C, 21Bk) as an image carrier.

Photoreceptor 21 contains an organic photoreceptor in which a photoreceptor layer containing a resin in which an organic photoconductor is incorporated is formed on a peripheral surface of a drum shaped metal support, which is placed extending toward the width direction of image forming support P (a direction perpendicular to the paper sheet in FIG. 2). As a resin for the photoreceptor layer formation, a well-known resin forming a photoreceptor layer such as polycarbonate is used. In the embodiment shown in FIG. 2, an example in which a drum shaped photoreceptor 21 is used, however, the photoreceptor is not limited thereto and a belt shaped photoreceptor may be used.

Developing member 24 each include a two-component developer containing each of a clear toner according to the present invention (S), a yellow toner (Y), a magenta toner (M), a cyan toner (C), and a black toner (Bk), and a carrier. A two-component developer is constituted of color toners of each color each containing a carrier having ferrite particles on which an insulating resin is coated, a colorant such as a well-known binder resin, a well-known pigment or carbon black, a charge control agent, silica, or titanium oxide.

As for a carrier, the average particle diameter is 10 to 50 μm and the saturation magnetization is 10-80 emu/g. The average particle diameter of the toner is 4 to 10 μm. The electrification characteristic of the toner used in the image forming device shown in FIG. 2 including the clear toner according to the present invention is preferably negative electrification characteristic and the amount of average electric charge is preferably −20 to −60 mC/g. The mixing ratio of the toner and the carrier in a two-component developer is adjusted so that the content of the toner is 4 to 10 weight %.

Intermediate transfer belt 26 which is an intermediate transfer medium is rotatably supported by plural rolls. Intermediate transfer belt 26 is an endless belt exhibiting a volume resistance of preferably $10^6$ to $10^{12}$ Ω·cm. Intermediate transfer belt 26 may be formed by a well-known resin, for example, polycarbonate (PC), polyimide (PI), polyamideimide (PAI), polyvinylideine fluoride (PVDF), or a tetrafluoroethylene-ethylene copolymer (ETFE). The thickness of intermediate transfer belt 26 is preferably 50 to 200 μm.

The clear toner layer formed by clear toner layer forming unit 20S and each color image formed on each photoreceptor 21 (21S, 21Y, 21M, 21C, 21Bk) by each of toner image forming units 20Y, 20M, and 20C is sequentially transferred on to intermediate transfer belt 26 employing primary each transfer roller 27 (27S, 27Y, 27M, 27C, and 27Bk) (primary transfer), whereby a clear toner layer and a combined full color image is formed. After the images are transferred, each photoreceptor of 21Y, 21M, 21C and 21Bk is subjected to cleaning by each cleaning member 25 (25S, 25Y, 25M, 25C, 25Bk) to remove residual toner.

Image forming support P stored in storing member 41 (tray) in sheet feeder 40 is fed to first feeding member 42 and conveyed through feeing rolls 43, 44, 45A, 45B, and resist roll 46 (second feeding member) to secondary transfer roll 29, where the clear toner layer and the full color image are transferred (secondary transfer).

The three vertically arrayed storing members 41 in the lower portion of image forming device 2 were provided with the same number since these three members have almost the same structure. Also, the three vertically arrayed feeding members 42 were provided with the same number since the structures are almost the same. Storing members 41 and feeding members 42 in all are named as sheet feeder 40.

Image forming support P on which has been transferred the clear toner layer and the full color image is held by fixing unit 50, and the clear toner and each toner are melted then solidified by the effects of heating and pressurizing.

Thus, fixing unit 50 fixes the full color toner image on which the clear toner layer has been formed all over the image carrier on the image forming support P. The image forming support P is conveyed between a pair of conveying rolls 57, discharged through discharge rolls 47, and placed on a discharge tray which is outside of the image forming device.

After transferring the clear toner layer and the full color toner image onto image forming support P using secondary transfer roll 29 and separating image forming support P by curvature separation, the residual toner on intermediate transfer belt 26 is removed by cleaning member 261.

When a full color image having clear toner layers on both surfaces of image forming support P is intended to form, image forming support P is branched from the conveyance pass for discharging by branching plate 49, after the clear toner layer and the full color image formed on the first side surface of image forming support P have been subjected to the melt/solidify treatment, to introduce into double surface conveyance pass 48 to convert the front side and the rear side and then conveyed again through feed roll 45B. Also on the second surface, a clear toner layer and full color images containing each color are formed using clear toner layer forming unit 20S and image forming unit of each color 20Y, 20M, 20C and 20Bk, followed by being subjected to a heating/pressurizing treatment using fixing unit 50 and discharging out of the image forming device using discharging rolls 47. Thus, a full color toner image on both surfaces of image forming support P are provided with a matted finish exhibiting a matt texture appearance.

As mentioned above, a full color image having a matted finish exhibiting a rich matt texture appearance can be formed all over the image forming support P with image forming device 2 shown in FIG. 2. In the present invention, clear toner layer forming device 1 can be arranged to the image forming device 2 of FIG. 2 in the manner as shown in FIG. 3. Here, FIG. 3 is a schematic diagram showing an example of a device in which clear toner layer forming device 1 is installed in image forming device 2 of FIG. 2. In FIG. 3, there is illustrated an image forming device in which clear toner layer forming device 1 is installed at the position of discharging member 90 of image forming device 2 shown in FIG. 2, in which image forming support P fixed in fixing member 50 installed in image forming device 2 is further treated in clear toner layer forming device 1 to further fix the clear toner layer formed on the entire surface of the image forming support, whereby the clear toner layer can produce a full color image having a matted finish exhibiting a rich matt texture appearance. The obtained image is preferable as an outdoor poster since the fixing strength of the toner image is also increased.

Figure 4:
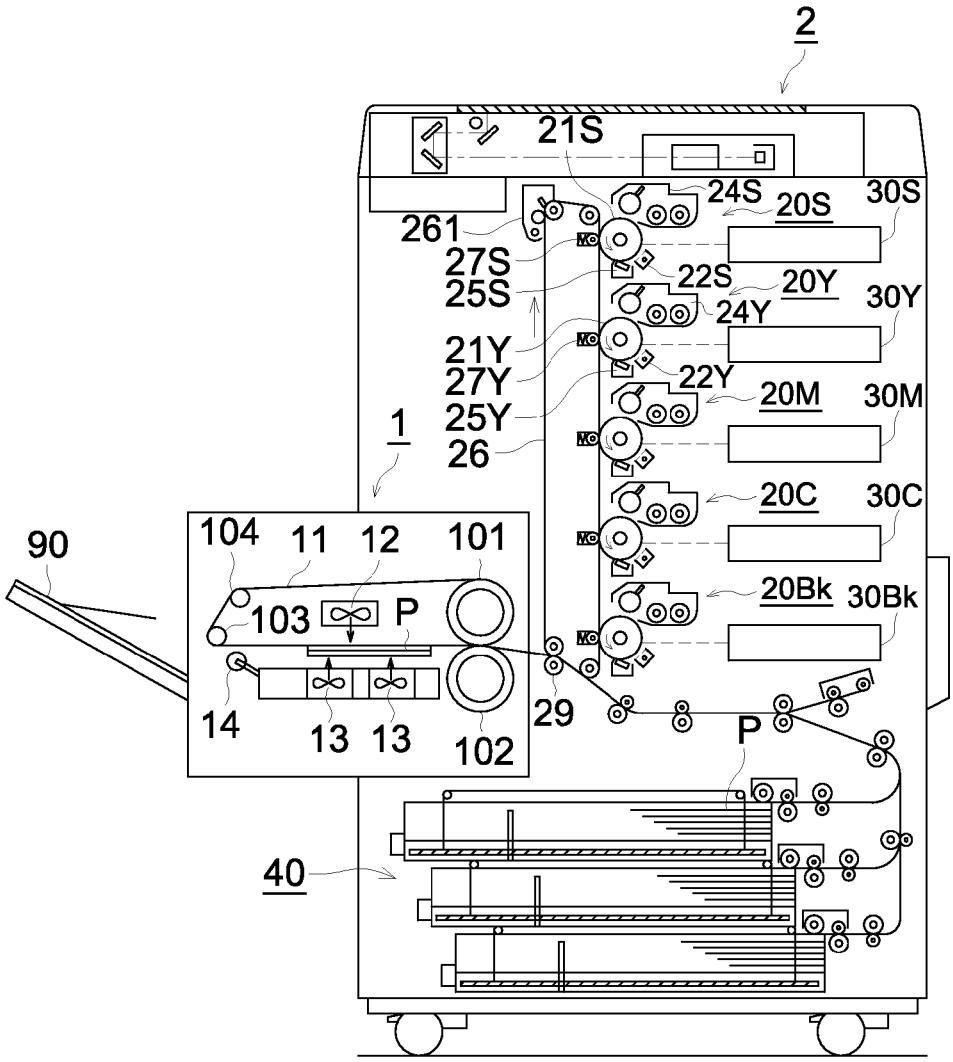
FIG. 4 is a schematic diagram showing an example of a device in which a clear toner layer forming device is installed in the image forming device of FIG. 2.

In FIG. 4, there is illustrated an image forming device in which clear toner layer forming device 1 is installed at the position of fixing device 50 of image forming device 2 shown FIG. 2, in which the clear toner layer and the full color toner image transferred on image forming support P by secondary transfer roll 29 are simultaneously fixed by clear toner layer forming device 1. The image forming device shown in FIG. 4 is preferable in order to realize downsizing of the device, since clear toner layer forming device 1 is installed inside of the image forming device 2.

An image forming support on which can form an image employing the clear toner according to the present invention is also called as a transfer material. It is not specifically limited if it is possible to form an image via a well known method, to form a clear toner layer and to hold the clear toner layer. As the image forming supports usable in the present invention, well known materials can be cited, for example, a plain paper from a thin paper to a thick paper, a fine quality paper, and an art paper, a coated printing paper, a commercial Japanese paper, a post card paper, a plastic film for an over head projector and a cloth.

EXAMPLES

The embodiments of the present invention will now be specifically explained by referring to examples, however, the present invention is not limited thereto. The "part" or "parts" used in the following description represents "weight part" or "weight parts", respectively.

1. Preparation of Clear Toners 1 to 16

16 kinds of clear toners 1 were prepared as are described below.

1-1. Preparation of "Clear toner 1"

(1) Preparation of "Resin Particles 1"

(a) 1$^{st}$ Step Polymerization

In a reaction vessel equipped with an agitator, a temperature sensor, a condenser tube, and a nitrogen introduction device, 2.0 parts of an anionic surfactant (sodium dodecylbenzene sulfonate: SDS) was dissolved in 2,900 parts of water to obtain an aqueous surfactant solution. The temperature of the aqueous surfactant solution was raised to 80° C. under a nitrogen gas stream while agitating the aqueous surfactant solution at a mixing rate of 230 rpm.

To the aforesaid aqueous surfactant solution was added 9.0 parts of polymerization initiator (potassium persulfate: KPS). After the inner temperature of the mixture was raised to 80° C., the following mixture solution (1) shown below was dropped spending 3 hours.

| | |
|---|---|
| Styrene | 551 weight parts |
| Compound (1)-15 (myristyl acrylate: $CH_2{=}CHCOOC_{14}H_{29}$) | 280 weight parts |
| Methacrylic acid | 44 weight parts |
| n-Octylmercaptan | 19 weight parts |

After completion of dropping of the mixture solution (1), the solution was stirred with heating at 78° C. for 1 hour to perform polymerization reaction. Thus, "resin particle dispersion a1" was obtained.

(b) 2$^{nd}$ Step Polymerization

In a reaction vessel equipped with an agitator, the following compounds were placed to prepare mixture solution (2).

| | |
|---|---|
| Styrene | 107 weight parts |
| n-Butyl acrylate | 50 weight parts |
| Methacrylic acid | 8 weight parts |
| n-Octylmercaptan | 4 weight parts |

Meanwhile, an aqueous surfactant solution was prepared by dissolving 2.0 parts of an anionic surfactant (sodium polyoxy(2) dodecyl ether sulfonate) in 1,100 parts of ion exchanged water. After the aqueous surfactant solution was heated to 90° C., the following material was added to the aqueous surfactant solution.

| | |
|---|---|
| "Resin particle dispersion a1" | 245 parts (solid content converted value) |

After adding the aforesaid mixture solution (2) to the mixture, the mixed composition was subjected to mixing treatment and dispersion treatment for 4 hours using a mechanical dispersion apparatus having a circulating path "CLEAMIX" (made by M Technique Co., Ltd.) to obtain an emulsified particle dispersion having an average particle size of 350 nm. To the aforesaid emulsified particle dispersion was added a solution containing 2.5 parts of potassium persulfate (KPS) dissolved in 110 parts of water. The solution was stirred with heating at 90° C. for 2 hour to perform polymerization reaction (2$^{nd}$ step polymerization). Thus, "resin particle dispersion a11" was obtained.

(c) 3rd Step Polymerization

To the aforesaid "resin particle dispersion a11" was added a solution containing 2.5 parts of potassium persulfate (KPS) dissolved in 110 parts of water. After the mixture was heated to 80° C., the following mixture solution (3) shown below was dropped spending 1 hour.

| | |
|---|---|
| Styrene | 238 weight parts |
| n-Butyl acrylate | 92 weight parts |
| n-Octylmercaptan | 4.2 weight parts |

After completion of dropping of the mixture solution (3), the solution was stirred with heating at 80° C. for 3 hour to perform polymerization reaction (3rd step polymerization), then the solution was cooled to 28° C. Thus, "resin particles 1" was obtained.

(2) Preparation of "Clear Toner 1"

(a) Preparation of "Clear Toner Parent Particles 1": Coagulation/Fusion Step

In a reaction vessel equipped with an agitator, a temperature sensor, a condenser tube, and a nitrogen introduction device, the following materials were added and stirred.

| | |
|---|---|
| "Resin particles 1" | 440 weight parts |
| Ion exchanged water | 1,100 weight parts |

After adjusting the inner temperature of the reaction vessel to 30° C., an aqueous sodium hydroxide solution having a content of 5 mol/L was added to adjust the pH value to 10.

Subsequently, an aqueous solution prepared by dissolving 35 parts of magnesium chloride hexahydrate in 35 parts of ion exchanged water was added over 10 minutes while agitating at 30° C. After leaving still for 3 minutes, the temperature of the mixture was started to raise, and the temperature was raised to 90° C. in 60 minutes. While keeping the temperature at 90° C., coagulation and fusion of the above-described particles were continued. In this state, using MUTISIZER 3 (produced by BECKMAN COULTER), the particle diameter of the particles obtained by the coagulation and fusion was measured, and, when the volume median diameter of the particles increased to 5.5 μm, an aqueous solution obtained by dissolving 40.2 parts of sodium chloride in 1,000 parts of ion exchanged water was added to stop the aggregation of the particles.

After aggregation was stopped, the temperature of the liquid was kept at 90° C. for ripening. Heating with agitation was done for 3 hours to continue fusion of the particles were to prepare "clear toner parent particles 1".

Then, the liquid was cooled to 30° C., the pH value of the liquid was adjusted to 2 using hydrochloric acid, and agitation was stopped.

"Clear toner parent particles 1" obtained via the above processes were subjected to solid-liquid separation using a basket centrifuge MARK III type number 60×40 (produced by made from MATSUMOTO MACHINE CO., Ltd.), whereby a wet cake of "clear toner parent particles 1" was obtained. This wet cake was washed using ion exchange water of 45° C. until the electrical conductivity of the filtrate obtained by the basket centrifuge became 5 μS/cm. Then, the cake was transferred to a flash jet dryer (produced by SEISHIN ENTERPRISE Co., Ltd.), and dried until the water content decreased to 0.5 weight %. Thus, "clear toner parent particles 1" were obtained.

(b) External Additive Treatment

To the prepared "clear toner parent particles 1" were added the following external additives, and the external additive treatment was carried out using a HENSCHEL MIXER produced by MITSUI MIKE KOGYO Co., Ltd., whereby "clear toner 1" was obtained.

| | |
|---|---|
| Silica treated with hexamethyl silazane (an average primary particle diameter: 12 nm, hydrophobicity: 68) | 1.0 weight part |
| Titanium dioxide treated with n-octylsilane (an average primary particle diameter: 12 nm, hydrophobicity: 63) | 0.3 weight parts |

The external additive treatment using a HENSCHEL MIXER was carried out under the condition of, peripheral speed of the impeller: 35 m/second, treatment temperature: 35° C. and treatment duration: 15 minutes.

"Clear toner 1" was produced with the above-described process.

The content of Compound (1)-15 (myristyl acrylate) contained in the constituting resin of the aforesaid "clear toner 1" was 10.6 weight %. This value can be determined by the following process.

First, the total amount of the used polymerizable monomers in the 1st step polymerization is 875 parts. Since the amount of myristyl acrylate in the composition is 280 parts, the content of myristyl acrylate is 28 weight %.

Next, in the 2nd step polymerization, since 165 parts of polymerizable monomers including styrene were added to 245 parts of "resin particles a1", the total amount of the used polymerizable monomers in the 2nd step polymerization is 410 parts. Among these, the content of myristyl acrylate is calculated as 19.1 weight % (from calculation of: 280×245/875=78.4 parts, 78.4/410×100).

Further, in the 3rd step polymerization, since 330 parts of polymerizable monomers including styrene were added to 410 parts of "resin particles a11", the total amount of the used polymerizable monomers in the 3rd step polymerization is 740 parts. Among these, the content of Compound (1)-15 (myristyl acrylate) is calculated as 10.6 weight % (from calculation of: 78.4/740×100).

1-2. Preparation of "Clear Toners 2 to 10"

(1) Preparation of "Clear toner 2"

"Clear toner 2" was prepared in the same manner as preparation of the aforesaid "clear toner 1", except that Compound (1)-15 (myristyl acrylate) used in the 1st step polymerization for producing "resin particles 1" was replaced with 280 parts of Compound (1)-14 (lauryl acrylate: $CH_2{=}CHCOOC_{12}H_{25}$). The content of Compound (1)-14 contained in "clear toner 2" was 10.6 weight % determined by the aforesaid calculation process.

(2) Preparation of "Clear Toner 3"

"Clear toner 3" was prepared in the same manner as preparation of the aforesaid "clear toner 1", except that Compound (1)-15 (myristyl acrylate) used in the 1st step polymerization for producing "resin particles 1" was replaced with 290 parts of Compound (1)-17 (stearyl acrylate: $CH_2{=}CHCOOC_{18}H_{37}$). The content of Compound (1)-17 contained in "clear toner 3" was 10.8 weight % determined by the aforesaid calculation process.

(3) Preparation of "Clear Toner 4"

"Clear toner 4" was prepared in the same manner as preparation of the aforesaid "clear toner 1", except that Compound (1)-15 (myristyl acrylate) used in the 1st step polymerization for producing "resin particles 1" was replaced with 300 parts of Compound (1)-5 (isostearyl methacrylate: $CH_2{=}C(CH_3)COOC_{18}H_{37}$). The content of Compound (1)-5 contained in "clear toner 4" was 11.1 weight % determined by the aforesaid calculation process.

(4) Preparation of "Clear Toner 5"

"Clear toner 5" was prepared in the same manner as preparation of the aforesaid "clear toner 1", except that Compound (1)-15 (myristyl acrylate) used in the 1st step polymerization for producing "resin particles 1" was replaced with 250 parts of Compound (1)-6 (behenyl methacrylate: $CH_2{=}C(CH_3)COOC_{22}H_{45}$). The content of Compound (1)-6 contained in "clear toner 5" was 9.8 weight % determined by the aforesaid calculation process.

(5) Preparation of "Clear Toner 6"

"Clear toner 6" was prepared in the same manner as preparation of the aforesaid "clear toner 1", except that Compound (1)-15 (myristyl acrylate) used in the 1st step polymerization for producing "resin particles 1" was replaced with 300 parts of Compound (1)-12 (cyclohexyl methacrylate: $CH_2{=}C(CH_3)COOC_6H_{11}$). The content of Compound (1)-12 contained in "clear toner 6" was 11.1 weight % determined by the aforesaid calculation process.

(6) Preparation of "Clear Toner 7"

"Clear toner 7" was prepared in the same manner as preparation of the aforesaid "clear toner 1", except that Compound (1)-15 (myristyl acrylate) used in the 1st step polymerization for producing "resin particles 1" was replaced with 280 parts of Compound (1)-26 (isobornyl acrylate). The content of Compound (1)-26 contained in "clear toner 7" was 10.6 weight % determined by the aforesaid calculation process.

(7) Preparation of "Clear Toners 8 to 10"

"Clear toner 8" was prepared in the same manner as preparation of the aforesaid "clear toner 1", except that Compound (1)-15 (myristyl acrylate) used in the 1st step polymerization for producing "resin particles 1" was replaced with 320 parts of acrylic ester having a structure of $CH_2{=}CHCOOC_{10}H_{21}$. The content of the aforesaid acrylic ester contained in "clear toner 8" was 11.6 weight % determined by the aforesaid calculation process.

"Clear toner 9" was prepared in the same manner as preparation of the aforesaid "clear toner 1", except that Compound (1)-15 (myristyl acrylate) used in the 1st step polymerization for producing "resin particles 1" was replaced with 250 parts of acrylic ester having a structure of $CH_2{=}CHCOOC_{25}H_{51}$. The content of the aforesaid acrylic ester contained in "clear toner 9" was 9.8 weight % determined by the aforesaid calculation process.

Further, "clear toner 10" was prepared in the same manner as preparation of the aforesaid "clear toner 1", except that the mixture solution (1) used in the 1st step polymerization for producing "resin particles 1" was replaced with the following composition without containing myristyl acrylate:

| | |
|---|---|
| Styrene | 560 weight parts |
| n-Butyl acrylate | 250 weight parts |
| Methacrylic acid | 44 weight parts |
| n-Octylmercaptan | 19 weight parts. |

1-3. Preparation of "Clear Toners 11 to 16"

(1) Preparation of "Clear Toners 11 and 12"

"Clear toner 11" was prepared in the same manner as preparation of the aforesaid "clear toner 1", except that Compound (1)-15 (myristyl acrylate) used in the 1st step polymerization for producing "resin particles 1" was replaced with 280 parts of Compound (1)-3 (palmityl acrylate: $CH_2{=}CHCOOC_{16}H_{33}$). The content of Compound (1)-3 contained in "clear toner 11" was 10.6 weight % determined by the aforesaid calculation process.

Further, "clear toner 12" was prepared in the same manner as preparation of the aforesaid "clear toner 1", except that the mixture solution (1) used in the 1st step polymerization for producing "resin particles 1" was replaced with the following composition:

| | |
|---|---|
| Styrene | 798 weight parts |
| Compound (1)-3 (palmityl acrylate: $CH_2{=}CHCOOC_{16}H_{33}$) | 13 weight parts |
| Methacrylic acid | 64 weight parts |
| n-Octylmercaptan | 19 weight parts. |

The content of Compound (1)-3 contained in "clear toner 12" was 0.5 weight % determined by the aforesaid calculation process.

(2) Preparation of "Clear Toners 13 and 14"

"Clear toner 13" was prepared in the same manner as preparation of the aforesaid "clear toner 1", except that the mixture solution (1) used in the 1st step polymerization for producing "resin particles 1" was replaced with the following composition:

| | |
|---|---|
| Styrene | 688 weight parts |
| Compound (1)-3 (palmityl acrylate: $CH_2{=}CHCOOC_{16}H_{33}$) | 132 weight parts |
| Methacrylic acid | 55 weight parts |
| n-Octylmercaptan | 19 weight parts. |

The content of Compound (1)-3 contained in "clear toner 13" was 5.0 weight % determined by the aforesaid calculation process.

"Clear toner 14" was prepared in the same manner as preparation of the aforesaid "clear toner 1", except that the mixture solution (1) used in the 1st step polymerization for producing "resin particles 1" was replaced with the following composition:

| | |
|---|---|
| Styrene | 444 weight parts |
| Compound (1)-3 (palmityl acrylate: $CH_2{=}CHCOOC_{16}H_{33}$) | 396 weight parts |
| Methacrylic acid | 35 weight parts |
| n-Octylmercaptan | 19 weight parts. |

The content of Compound (1)-3 contained in "clear toner 14" was 14.9 weight % determined by the aforesaid calculation process.

(3) Preparation of "Clear toners 15 and 16"

"Clear toner 15" was prepared in the same manner as preparation of the aforesaid "clear toner 1", except that the mixture solution (1) used in the 1st step polymerization for producing "resin particles 1" was replaced with the following composition:

| | |
|---|---|
| Styrene | 322 weight parts |
| Compound (1)-3 (palmityl acrylate: $CH_2{=}CHCOOC_{16}H_{33}$) | 528 weight parts |
| Methacrylic acid | 25 weight parts |
| n-Octylmercaptan | 19 weight parts. |

The content of Compound (1)-3 contained in "clear toner 15" was 20.0 weight % determined by the aforesaid calculation process.

"Clear toner 16" was prepared in the same manner as preparation of the aforesaid "clear toner 1", except that the mixture solution (1) used in the 1st step polymerization for producing "resin particles 1" was replaced with the following composition:

| | |
|---|---|
| Styrene | 224 weight parts |
| Compound (1)-3 (palmityl acrylate: $CH_2{=}CHCOOC_{16}H_{33}$) | 613 weight parts |
| Methacrylic acid | 18 weight parts |
| n-Octylmercaptan | 19 weight parts. |

The content of Compound (1)-3 contained in "clear toner 16" was 23.2 weight % determined by the aforesaid calculation process.

As described above, "clear toners 11 to 16" having a different content of "compound (1)-3" were prepared.

As described above, "clear toners 1 to 16" were prepared. The content of the acrylic ester and alkyl carbon number in the alcohol portion of the acrylic ester for preparing "clear toners 1 to 16" are listed in the following Table 2.

TABLE 2

| | Acrylic acid ester monomer | | |
|---|---|---|---|
| Clear toner | Kind | Carbon number | Content (weight %) |
| 1 | (1)-15 | 14 | 10.6 |
| 2 | (1)-14 | 12 | 10.6 |
| 3 | (1)-17 | 18 | 10.8 |
| 4 | (1)-5 | 18 | 11.1 |
| 5 | (1)-6 | 22 | 9.8 |
| 6 | (1)-12 | Cyclic | 11.1 |
| 7 | (1)-26 | Cyclic | 10.6 |
| 8 | ※1 | 10 | 11.6 |
| 9 | ※2 | 25 | 9.8 |
| 10 | — | — | 0 |
| 11 | (1)-3 | 16 | 10.6 |
| 12 | (1)-3 | 16 | 0.5 |
| 13 | (1)-3 | 16 | 5.0 |
| 14 | (1)-3 | 16 | 14.9 |
| 15 | (1)-3 | 16 | 20.0 |
| 16 | (1)-3 | 16 | 23.2 |

※1: acrylic acid ester having a structure of $CH_2{=}CHCOOC_{10}H_{21}$.
※2: acrylic acid ester having a structure of $CH_2{=}CHCOOC_{25}H_{51}$ 2. Evaluation 2-1. Preparation of Clear Toner Developer A ferrite carrier having an average particle diameter of 40 μm covered with a methyl methacrylate resin was mixed with each of "clear toners 1 to 16" so that the content of each clear toner becomes 6 weight %. Thus "clear toner developers 1 to 16" which were two-component developers were prepared.

2-2. Evaluation Experiment (1) Evaluation Condition

Each of clear toner developers 1 to 16 was charged in clear toner layer forming device 1 shown in FIG. 1, and a clear toner layer was fanned on each of the A4 sized image forming support on which the same images had been formed by each of the following commercially available image forming devices. The conditions clear toner layer forming device 1 will be described later. As an image forming support, commercially available "OK TOP COAT+" produced by OJI PAPER Co., Ltd. (basis weight of 157 g/m$^2$, thickness of 131 μm) was used. As image forming devices used for forming the image, the following commercially available devices (a) to (c) were used, and 30,000 sheets by each image forming device, in total 90,000 sheets of image forming support for evaluation were printed. Then, a continuous operation of 90,000 sheets was carried out using clear toner layer forming device 1. The samples prepared by using Clear toners 1 to 7 and 11 to 16, which were within the scope of the present invention were designated as Examples 1 to 13, respectively. The samples prepared by using Clear tones 8 to 10, which were outside of the scope of the present invention were designated as Comparative Examples 1 to 3, respectively.

Used image forming devices were as follows:

(a) Electrophotographic printing method: BIZHUB C353 (produced by Konica Minolta Business Technologies, Inc.)

(b) Inkjet printing method: Ink-jet printer PX-5800 (produced by SEIKO EPSON Corp.)

(c) Plate printing method: RISO digital screen plate maker SP400D (produced by RISO KAGAKU Corp.)

In the above continuous operation using clear toner layer forming device 1, the image sheets were supplied to clear toner layer forming device 1 so that the image sheet formed by each of above three image forming devices was sequentially supplied one by one, namely, the image prints were supplied, for example, in the order: an image print formed by Electrophotographic method→an image print formed by Ink-jet method→an image print formed by Printing method, and so on, one by one.

The conditions for clear toner layer forming device 1 shown in FIG. 1 were set as follows.

(a) Amount of developed clear toner: 4 g/m$^2$ (b) Material of the belt member: polyimide film (thickness of 50 μm) on which a PFA layer (thickness of 10 μm) was provided (c) Surface roughness (initial surface roughness) of the belt member: Ra 0.4 μm (d) Surface temperature of the belt member: 130° C.

(e) Specifications of the heating/pressurizing roll;

Heating roll: outer diameter of 100 mm, 10 mm thick aluminum support

Pressurizing roll: outer diameter of 80 mm, 10 mm thick aluminum support having thereon 3 mm thick silicone rubber layer Heat source: halogen lamp is installed in heating roll and pressurizing roll to adjust the roll surface temperature of the heating roll to be 155° C. and that of the pressurizing roll to be 115° C. (temperature is controlled by thermistor)

Nip width between the heating roll and the pressurizing roll: 11 mm

Surface pressure of the press contact portion (nip portion): 200 kPa (f) Temperature of image forming support at release roll: set to be 50±5° C.

(g) Distance between the nip portion of heating/pressurizing roll and release roll: 620 mm (h) Conveyance speed of the image forming support: 220 mm/second (i) Conveyance direction of the mage forming support: convey in a longitudinal direction of the aforesaid A3 sized image forming support (j) Evaluation of environment: Normal temperature and normal humidity (temperature of 20° C., relative humidity of 50% RH).

(2) Evaluation of Matted Finish (Matt Texture Appearance)<
<Quantitative Evaluation Using Gloss Meter>

The gloss of each of the prints prepared as described above was measured using a commercially available gloss meter GXM-203 (produced by Murakami Color Research Laboratory Co., Ltd.) shown in FIG. 5. The measurement was carried out based on MS Z8741 1983 method 2 by setting an incident angle of 75°. The gloss of the prints prepared at the beginning of printing (initial print), at 30,000$^{th}$ sheet printing and at 90,000$^{th}$ sheet printing each was measured. The prints exhibiting glossiness of 20 or less were evaluated as "acceptable". Glossiness was measured at five points in the center portion and the four corners of the prints, and the mean value of the five values was determined as a glossiness of the print. The evaluation results are shown in the following Table 3.

TABLE 3

| | Clear toner No. | Electrophotographic printing image | | | InkJet printing image | | | Plate printing image | | |
|---|---|---|---|---|---|---|---|---|---|---|
| | | Initial print | 30,000th print | 90,000th print | Initial print | 30,000th print | 90,000th print | Initial print | 30,000th print | 90,000th print |
| Example 1 | 1 | 12 | 13 | 13 | 13 | 13 | 13 | 12 | 13 | 13 |
| Example 2 | 2 | 17 | 19 | 20 | 16 | 18 | 20 | 16 | 18 | 19 |
| Example 3 | 3 | 13 | 13 | 13 | 13 | 14 | 14 | 13 | 14 | 14 |
| Example 4 | 4 | 13 | 14 | 14 | 13 | 13 | 13 | 13 | 14 | 14 |
| Example 5 | 5 | 17 | 18 | 20 | 17 | 18 | 19 | 17 | 18 | 20 |
| Example 6 | 6 | 16 | 18 | 19 | 17 | 18 | 20 | 16 | 18 | 19 |
| Example 7 | 7 | 13 | 13 | 14 | 13 | 13 | 13 | 13 | 14 | 14 |
| Example 8 | 11 | 12 | 12 | 14 | 12 | 13 | 14 | 12 | 13 | 14 |
| Example 9 | 12 | 18 | 18 | 18 | 18 | 18 | 19 | 18 | 18 | 19 |
| Example 10 | 13 | 15 | 16 | 16 | 15 | 16 | 16 | 16 | 16 | 17 |
| Example 11 | 14 | 13 | 13 | 14 | 13 | 14 | 14 | 13 | 13 | 13 |
| Example 12 | 15 | 15 | 15 | 16 | 15 | 15 | 16 | 15 | 16 | 16 |
| Example 13 | 16 | 20 | 20 | 20 | 19 | 20 | 20 | 19 | 20 | 20 |
| Comparative Example 1 | 8 | 25 | 27 | 28 | 24 | 26 | 28 | 24 | 25 | 28 |
| Comparative Example 2 | 9 | 24 | 26 | 28 | 24 | 25 | 27 | 24 | 26 | 28 |
| Comparative Example 3 | 10 | 27 | 29 | 31 | 28 | 29 | 30 | 28 | 29 | 32 |

<Sensory Evaluation with Naked Eyes>

By carrying out visual observation of the finish of the prints used for the above-described quantitative evaluation using gloss meter, the homogeneity of the matted finish of the printed was evaluated. The evaluation was carries out by visual observation of the finish at 20 points arbitrary selected in a print, and the finished state was evaluated according to the following three ranks.

Rank A: it can be checked that sufficient matted finish is achieved

Rank B: matted finish is not sufficient but reflection of light is not detected.

Rank B: light is reflected and matted finish is not achieved.

When a print exhibited Rank A at 12 or more points, and no Rank C, this print was evaluated as acceptable (B). It means that homogeneous matted finish was achieved. Especially, when a print exhibited Rank A at 17 or more points, this print was evaluated as excellent (A). On the other hand, when a print exhibited Rank A at 11 or less points, this print was evaluated as unsatisfactory (C). The evaluation results are shown in the following Table 4.

TABLE 4

| | Clear toner No. | Electrophotographic printing image | | | InkJet printing image | | | Plate printing image | | |
|---|---|---|---|---|---|---|---|---|---|---|
| | | Initial print | 30,000th print | 90,000th print | Initial print | 30,000th print | 90,000th print | Initial print | 30,000th print | 90,000th print |
| Example 1 | 1 | A(20) | A(20) | A(20) | A(19) | A(19) | A(19) | A(19) | A(19) | A(19) |
| Example 2 | 2 | B(15) | B(15) | B(14) | B(15) | B(15) | B(15) | B(15) | B(14) | B(14) |
| Example 3 | 3 | A(19) | A(18) | A(18) | A(19) | A(18) | A(18) | A(18) | A(18) | A(18) |
| Example 4 | 4 | A(20) | A(19) | A(19) | A(20) | A(20) | A(19) | A(20) | A(20) | A(19) |
| Example 5 | 5 | B(15) | B(14) | B(14) | B(15) | B(14) | B(14) | B(15) | B(15) | B(15) |
| Example 6 | 6 | B(15) | B(15) | B(14) | B(15) | B(15) | B(15) | B(15) | B(15) | B(14) |
| Example 7 | 7 | A(18) | A(18) | A(17) | A(18) | A(17) | A(17) | A(18) | A(18) | A(18) |
| Example 8 | 11 | A(20) | A(20) | A(20) | A(20) | A(20) | A(19) | A(20) | A(19) | A(19) |
| Example 9 | 12 | B(13) | B(13) | B(14) | B(13) | B(13) | B(13) | B(14) | B(13) | B(13) |
| Example 10 | 13 | A(17) | B(16) | B(16) | B(16) | B(16) | B(16) | A(17) | A(17) | B(16) |
| Example 11 | 14 | A(20) | A(20) | A(19) | A(19) | A(19) | A(19) | A(20) | A(19) | A(19) |
| Example 12 | 15 | A(17) | A(17) | B(16) | A(17) | B(16) | B(16) | A(17) | A(17) | B(16) |
| Example 13 | 16 | B(15) | B(15) | B(15) | B(15) | B(15) | B(15) | B(15) | B(14) | B(14) |
| Comparative Example 1 | 8 | C(8) | C(9) | C(8) | C(9) | C(8) | C(9) | C(10) | C(10) | C(10) |
| Comparative Example 2 | 9 | C(8) | C(8) | C(9) | C(8) | C(9) | C(9) | C(8) | C(8) | C(9) |
| Comparative Example 3 | 10 | C(2) | C(2) | C(1) | C(3) | C(2) | C(3) | C(3) | C(3) | C(3) |

As are shown by the results in Table 3 and Table 4, it was confirmed that Examples 1 to 13 were able to stably produce a print having a good matted finish. Here, Examples 1 to 13 used a clear toner containing a resin formed with a polymer made by a compound represented by Formula (1) and a vinyl polymer. On the other hand, it was demonstrated that Comparative examples 1, which were not provided with the composition of the present invention, were not able to produce a print having a good matted finish which was achieved by Examples 1 to 13.

What is claimed is:

1. A method for forming an image comprising the steps of:

supplying a clear toner on a surface of an image forming support;

heating the supplied clear toner on the surface of the image forming support to melt;

close contacting the surface of the image forming support supplied with the clear toner with a belt; and cooling the clear toner in a state of close contacting with the belt so as to form a clear toner layer on the image forming support, wherein the clear toner comprises at least a resin formed with a polymerizable monomer represented by Formula (1) and a vinyl monomer, $$H_2C{=}CR_1{-}COOR_2 \qquad \text{Formula (1)}$$

wherein $R_1$ represents a hydrogen atom or a methyl group; and $R_2$ represents a chain alkyl group having 12 to 22 carbon atoms, or a cyclic alkyl group.

2. The method for forming an image of claim 1, wherein a content of the polymerizable monomer represented by Formula (1) which forms the resin is from 0.5 to 20 weight % based on the total weight of the resin.

3. The method for forming an image of claim 1, wherein $R_2$ in Formula (1) represents a chain alkyl group selected from the group consisting of a myristyl group, a palmityl group, a stearyl group and a behenyl group.

4. The method for forming an image of claim 1, wherein $R_2$ in Formula (1) represents a cyclic alkyl group having a 5 to 10 sized ring.

5. The method for forming an image of claim 4, wherein $R_2$ in Formula (1) represents a cyclohexyl group or a isobornyl group.

6. The method for forming an image of claim 1, wherein the resin formed with a polymerizable monomer represented by Formula (1) and a vinyl monomer has a number average molecular weight Mn of 5,000 to 50,000.

7. The method for forming an image of claim 1, wherein the resin formed with a polymerizable monomer represented by Formula (1) and a vinyl monomer has a ratio of Mw/Mn in the range of 1.0 to 1.5, provided that Mw is a weight average molecular weight and Mn is a number average molecular weight.

* * * * *